United States Patent [19]

Hoshino et al.

[11] Patent Number: 4,824,635

[45] Date of Patent: Apr. 25, 1989

[54] P-ADDED FERRITIC STAINLESS STEEL HAVING EXCELLENT FORMABILITY AND SECONDARY WORKABILITY

[75] Inventors: Kazuo Hoshino; Katsuhisa Miyakusu; Isami Shimizu, all of Yamaguchi, Japan

[73] Assignee: Nisshin Steel Co., Ltd., Tokyo, Japan

[21] Appl. No.: 40,102

[22] Filed: Apr. 20, 1987

Related U.S. Application Data

[63] Continuation-in-part of Ser. No. 737,405, May 24, 1985, abandoned.

[51] Int. Cl.[4] ..... C22C 38/32

[52] U.S. Cl. ..... 420/42; 420/62; 420/64

[58] Field of Search ..... 420/42, 62, 64, 87

[56] References Cited

U.S. PATENT DOCUMENTS 4,581,066 4/1986 Maruhashi et al. ..... 420/42

FOREIGN PATENT DOCUMENTS 2071148 9/1981 United Kingdom ..... 420/64

*Primary Examiner*—Deborah Yee

*Attorney, Agent, or Firm*—Wenderoth, Lind & Ponack

[57] ABSTRACT

Ferritic stainless steel consisting essentially of, in % by weight, 0.0050 to 0.0500 of C, 10.00 to 18.00 of Cr, up to 0.50 of Si, up to 0.50 of Mn, more than 0.040 but not more than 0.200 of P, up to 0.030 of S, up to 0.60 of Ni, 0.005 to 0.200 of Sol. Al, and 0.0020 to 0.0050 of B, the balance being Fe and impurities, and having a longitudinal cracking transition temperature of not higher than −10° C. as determined by the cup expansion test hereinbefore described. The steel has excellent formability and secondary workability.

1 Claim, 4 Drawing Sheets

P-ADDED FERRITIC STAINLESS STEEL HAVING EXCELLENT FORMABILITY AND SECONDARY WORKABILITY

CROSS-REFERENCE TO RELATED APPLICATION

This application is a continuation-in-part of our copending application Ser. No. 737,405 filed on May 24, 1985, and entitled P-added ferritic stainless steel having excellent formability and secondary workability, now abandoned.

TECHNICAL FIELD OF THE INVENTION

The present invention relates to a P-added ferritic stainless steel having excellent formability and secondary workability.

BACKGROUND OF THE INVENTION

Ferritic stainless steels have moderate workability and corrosion resistance in spite of the fact that they are relatively inexpensive when compared with austenitic stainless steels, and in consequence, relatively large quantities of ferritic stainless steels are commercially used in the manufacture of durable consumer goods, including kitchen units, and as construction materials. On the other hand, low chromium ferritic stainless steels, including those in accordance with AISI 409 and SUS 410L, are used in large quantities in the manufacture of automobile exhaust gas systems, because of their superior strength and oxidation resistance at an elevated temperature as well as corrosion resistance to low carbon steels. However, commercially available ferritic stainless steels, including those of low chromium, are still very expensive when compared with low carbon steels. Accordingly, it is strongly desired to develop more inexpensive ferritic stainless steels.

DESCRIPTION OF THE INVENTION

An object of the invention is to provide a novel ferritic stainless steel which can be economically produced and which has excellent formability and secondary workability.

In accordance with the invention there is provided a P-added ferritic stainless steel having excellent formability and secondary workability consisting essentially of, in % by weight, C; 0.005 to 0.0500%,
Cr; 10.00 to 18.00%,
Si; up to 0.50%,
Mn; up to 0.50%,
P; more than 0.040% but not more than 0.200%,
S; up to 0.030%,
Ni; up to 0.60%,
Sol. Al; 0.005 to 0.200%, and
B; 0.0020 to 0.0050%, the balance being Fe and unavoidable impurities, and having a longitudinal cracking transition temperature of not higher than −10° C. as determined by the cup expansion test described hereinafter.

DESCRIPTION OF THE INVENTION

The ferritic stainless steel in accordance with the invention is basically characterized by the feature that P, which has bee required to be reduced in conventional ferritic stainless steels, is positively added in an appropriate amount in relation to other alloying elements.

Of ferritic stainless steels, 9 species of hot rolled sheets are standardized in JIS G 4304, while 10 species of cold rolled sheets are standardized in JIS G 4305. Regarding the P content of these standardized ferritic stainless steel sheets, the standard prescribes not more than 0.030% of P for two species SUS 447 J1 (Cr; 28.50 to 32.00%) and SUS XM 27 (Cr; 25.00 to 27.50%), and not more than 0.040% for other species. On the one hand, a ferritic stainless steel has a crystalline structure of a body-centered cubic lattice which inherently leads to a reduced toughness of the material. On the other hand, Cr contained in the material in an amount as high as 11% or more, also acts to further reduce the toughness of the material. It is, therefore, believed that regarding impurities, which have been recognized as adversely affecting the toughness of the material, in particular P, the standard prescribes the strict provision of not more than 0.030 (or 0.040) % of P.

It was found that addition of an appropriate amount of P to a ferritic stainless steel improved the pickling performance of the hot rolled material as well as the workability of the cold rolled material.

Figure 1:
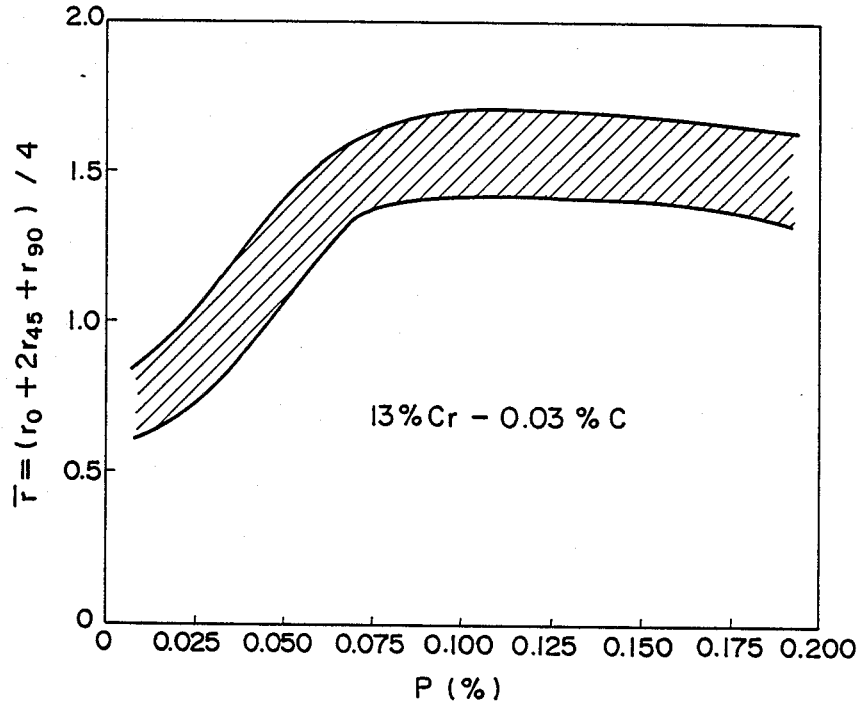
FIG. 1 is a graph showing, on 13% Cr-0.03% C ferritic stainless steels, an effect of the P content on the $\overline{\gamma}$ value.

FIG. 1 graphically shows an effect of P upon the $\gamma$ value of the cold rolled product, allowing for some variations in the measurement shown by the hatched area. The results shown in FIG. 1 were obtained on cold rolled sheets having a thickless of 0.7 mm and a basic composition of 13% Cr-0.03% C with varied P content. All the tested sheets were prepared by the same conventional procedure including the steps of hot rolling, annealing of the hot rolled sheet, cold rolling and annealing of the cold rolled sheet. As is well known in the art, the $\overline{\gamma}$ value is a typical measure representing the ability of the material of being deeply drawn. The greater the $\overline{\gamma}$ value, especially the more the $\overline{\gamma}$ value exceeds 1.0, the better the ability of the material of being deeply drawn. As seen from FIG. 1, with the P content of about 0.025% normally found in conventional ferritic stainless steels, the $\overline{\gamma}$ value is below 1.0. However, as the P content increases and exceeds 0.075%, the $\overline{\gamma}$/ value becomes higher eventually to 1.4 or more.

As already stated, the pickling performance of a hot rolled ferritic stainless steel is improved by addition of P. As a result, a pickling step can be advantageously carried out using hydrochloric acid normally employed in pickling low carbon steels, instead of using expensive nitric and hydrofluoric acids normally employed in pickling ferritic stainless steels.

The fact that the workability and pickling performance of ferritic stainless steels may be improved by enrichment of P, is very beneficial from the view point of providing inexpensive ferritic stainless steels. First of all, P itself is a very cheap element. For improving the workability of ferritic stainless steels expensive alloying elements, such as Ti, Nb and Al, have heretofore been employed, inevitably resulting in an increase of the price of the product. Enrichment of P may be carried out either by adding a suitable P source such as a Fe-P alloy, or by using a P-containing molten pig iron. In the former case an increase of the price of the product is very slight. In the latter case the price of the product can be rather reduced, since the P which has heretofore been removed is effectively utilized, and thus, the burden of dephosphorisation may be eliminated or reduced. Furthermore, it is possible in the latter case to use as raw materials P-containing iron and chromium ores which have been economically of low value as raw materials for the production of stainless steels because of their high P content, Secondly, the step of pickling the hot rolled material may be carried out using a hyrochloric acid pickling liquid, which is advantageous not only economically but also because of ease of the procedure.

However, there is no denying that the P in the ferritic stainless steel does frequently adversely affect some properties of the steel. The presence of P frequently impairs the toughness and secondary workability of the ferritic stainless steel.

We found that the adverse effect of P on the toughness of the ferritic stainless steel could be overcome by controlling C and Cr and adding a very slight amount of Sol. Al.

Figure 2:
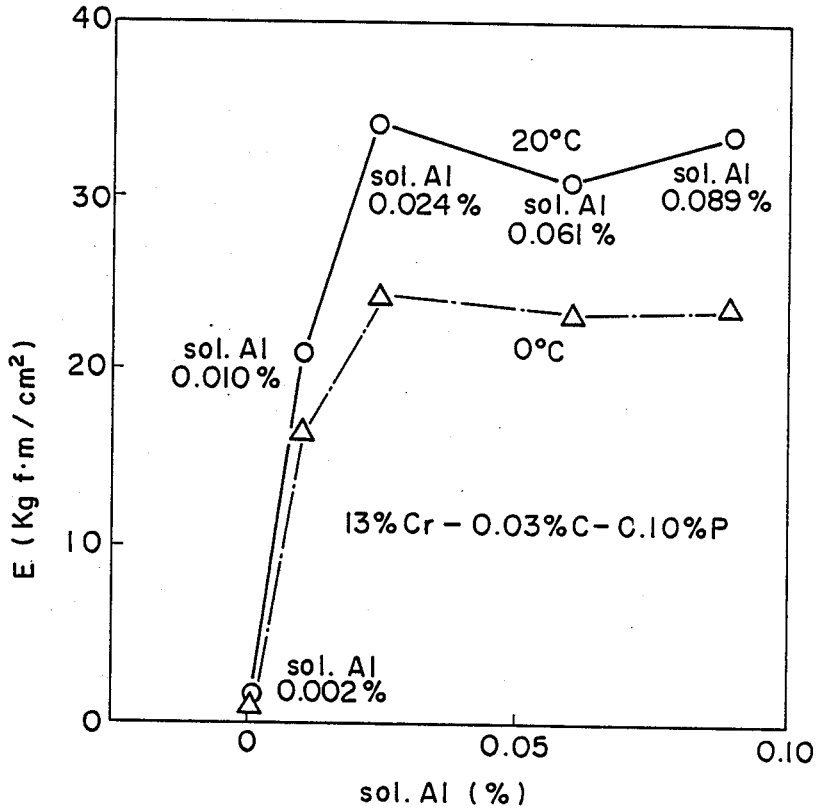
FIG. 2 is a graph showing, on 13% Cr-0.03% C-0.10% P ferritic stainless steels, an effect of the Sol. Al content on the Charpy impact value.

FIG. 2 graphically shows an effect of the Sol. Al content on the toughness (reflected by the Charpy impact value). The results shown in FIG. 3 were obtained on specimens having a basic composition of 13% Cr-0.03% C-0.10% P with various Sol. Al content, Each specimen had been prepared by forming a 30 kg ingot having the above-mentioned basic composition and the particular Sol. Al content, forging it at 1100° C., soaking the forged material at 760° C. for 4 hours and cutting off the specimen from the soaked material. The Charpy impact tests were carried out at temperatures of 20° C. and 0° C., respectively. It is generally said that the acceptable impact value is at least 5 kgf.m/cm$^2$. As seen from FIG. 2, while the impact value of the steel containing 0.002% of Sol. Al is nearly zero at the temperatures tested, as the Sol. Al content exceeds 0.005% and aproaches 0.010%, the impact value of the steel drastically increases well above the acceptable value of at least 5 kgf.m/cm$^2$, and with the Sol. Al content of more than about 0.020% the effect of Sol. Al to improve the toughness tends to be saturated.

By the term "secondary workability" we mean the workability of a deeply drawn material. We have experienced that when a cold rolled sheet of a P-enriched ferritic stainless steel is deeply drawn (a first draw) and then re-stroked (re-striking), or when a deeply drawn P-enriched ferritic stainless steel sheet experiences shock caused by flange cutting, brittle crackings (longitudinal crackings) frequently occur in parallel to the direction of the first draw. These crackings are attributed to a reduction in the toughness of the material due to the first draw, and the more likely to occur, the more severe the first draw and the lower the temperature. The second workability is a property of the material, which is different form the toughness and formability. It should be noted, therefore, that it is frequently the case wherein even if a material has an excellent ability of being deeply drawn as represented by its high $\overline{\gamma}$ value, it cannot be successfully shaped into the desired final product owing to its poor secondary workability.

Regarding the influence of P on the secondary workability of the P-enriched ferritic stainless steel, a precise operation mechanism is not yet fully understood. We are supposing, however, that whereas P is an element having a tendency to inherently segregate in grain boundaries, the action of P, which has segregated in grain boundaries, to weaken the intergranular bonding force is amplified by the first draw, whereby crackings due to intergranular fracture are likely to occur.

Figure 3:
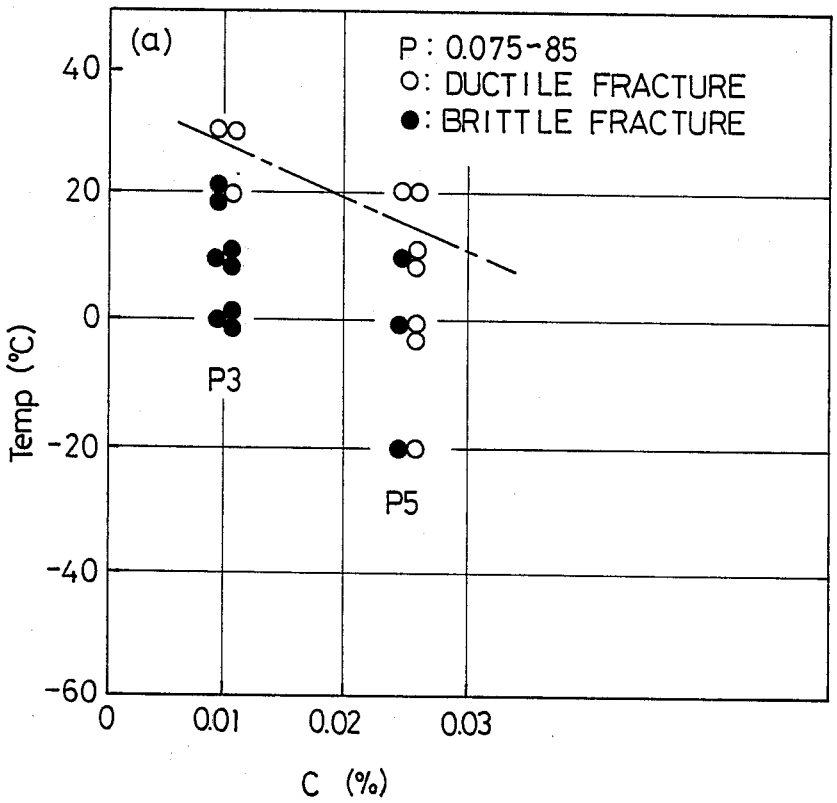
FIG. 3 is a graph showing, on 12% Cr-0.07580.085% P-tr.B ferritic stainless steels, an effect of the C content on the longitudinal cracking transition temperature.
Figure 4:
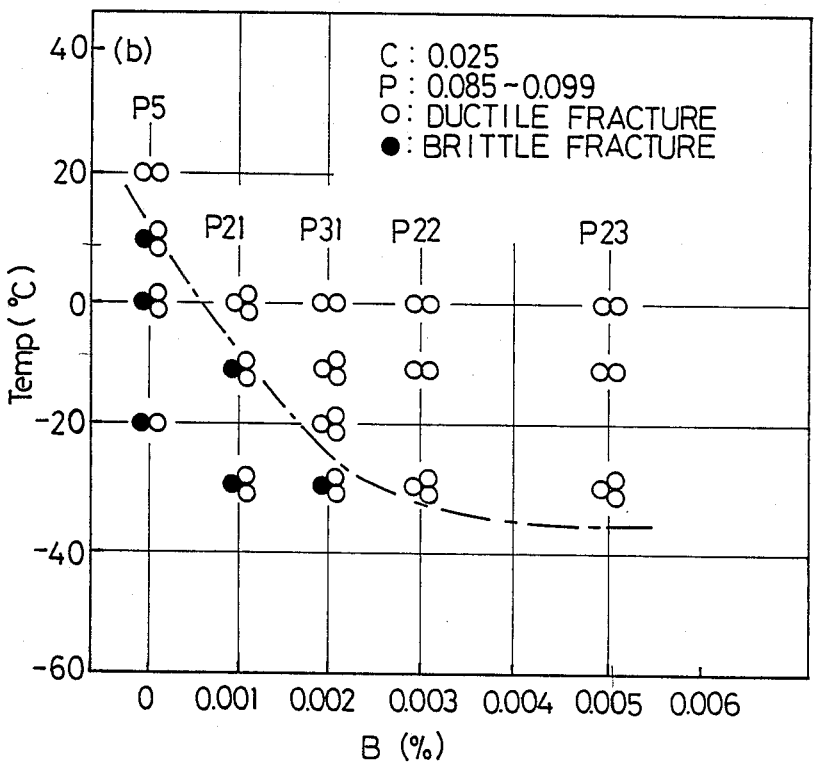
FIG. 4 is a graph showing, on 12% Cr-0.025% C-0.10% P ferritic stainless steels, an effect of the B content on the longitudinal cracking transition temperature.

FIGS. 3 and 4 show effects of C and B, respectively, on the secondary workability of some P-added ferritic stainless steels, The results shown in FIGS. 3 and 4 were obtained as follows.

Hot rolled sheets having chemical compositions indicated in Table 1 and a thickness of 3.2 cm were descaled by pickling, cold rolled to a thickness of 0.7 mm without any intermediate annealing, and then subjected to a finish annealing comprising steps of even heating at a temperature of 820° C. for one minute and allowing to cool in air.

TABLE 1

| | Chemical Composition of Tested Steels (% by weight) | | | | | | | | |
|---|---|---|---|---|---|---|---|---|---|
| Steel No. | C | Si | Mn | P | S | Cr | sol. Al | N | B |
| P3 | 0.0101 | 0.10 | 0.17 | 0.075 | 0.006 | 11.75 | 0.042 | 0.0099 | tr. |
| P5 | 0.0250 | 0.08 | 0.18 | 0.085 | 0.004 | 11.86 | 0.023 | 0.0098 | tr. |
| P21 | 0.0263 | 0.11 | 0.19 | 0.094 | 0.005 | 11.82 | 0.143 | 0.0092 | 0.0010 |
| P22 | 0.0252 | 0.11 | 0.19 | 0.099 | 0.005 | 11.99 | 0.057 | 0.0087 | 0.0030 |
| P23 | 0.0248 | 0.09 | 0.21 | 0.097 | 0.006 | 12.14 | 0.051 | 0.0091 | 0.0050 |
| P31 | 0.0242 | 0.13 | 0.18 | 0.090 | 0.003 | 11.91 | 0.026 | 0.0088 | 0.0020 |

To evaluate the secondary workability of the cold rolled and annealed sheet, it was deeply drawn into a cup having an external diameter of 27.0 mm, which was then expanded to fracture by means of a conical punch at a temperature within the range of from −30° C. and +30° C. indicated in FIGS. 3 and 4. The fracture of the cup was examined whether it was ductile or brittle. On one particular composition of steel to be tested several cups were prepared and two or more cups were expanded to fracture at a particular temperature to determined whether none of the tested cups has undergone brittle fracture at that temperature, In many cases it is sufficient to test two cups at one particular temperature, although testing of three or more cups at one particular temperature will give more reliable results. The lowest temperature at which none of the tested cups has undergone brittle fracture (longitudinal cracking) is referred to herein as the longitudinal cracking transition temperature or simply as the transition temperature ($T_{tr}$). The above-mentioned test for determining the longitudinal cracking transition temperature is referred to herein as the cup expansion test. It can be said that if steel exhibits a transition temperature of not higher than 0° C. in the above-mentioned cup expansion test, it has a satisfactory secondary workability as far as a moderate first draw concerns. However, in cases wherein the first deep drawing is severe, the transition temperature of the material determined by the above-mentioned cup expansion test should preferably be not higher than −10° C. in order that the material has a satisfactory secondary workability.

Test results are shown in FIGS. 3 and 4. In these Figures, each circle represents each run of cup expansion to fracture. The open circle indicates ductile fracture, while the solid circle indicates brittle fracture. The ordinate represents a temperature (°C.) at which cup expansion was carried out. FIG. 3 relates to steels P3 and P5 having a relatively high content of P ranging from 0.075 to 0.085%. It is revealed that increase of C slightly improves the secondary workability of high P ferritic stainless steels. However, the transition temperature of steel P5 is still substantially higher than 0° C., indicating its unsatisfactory secondary workability. FIG. 4 relates to steels P5, P21, P31, P22 and P23 having a basic composition of 12% Cr-0.025% C-0.10% P. FIG. 4 clearly reveals the fact that addition of B substantially improves the secondary workability of high P ferritic stainless steels. Steels P31, P22 and P23 containing at least 0.0020% of B have an excellent secondary workability as reflected by their low transition temperatures well below −10° C.

In addition to C and B, Sol. Al acts to enhance the secondary workability, whereas P and Cr adversely affect the secondary workability However, it is not established yet to unequivocally estimate the transition temperature of steel from the chemical composition of the material.

The precise operation mechanism by which C and B act to enchance the secondary workability of P-added ferritic stainless steels is not yet exactly understood. But we are supposing as follows. C and B themselves would presumably segregate in grain boundaries, thereby to strengthen the grain boundaries or to prevent P, which is harmful to the secondary workability, from segregating in the grain boundaries.

The reasons for the numerical restrictions of the individual alloying elements will now be described.

C should be at least 0.0050%. If it is unduly low, the desired secondary workability will not be achieved, However, an excessively high C not only renders the material unduly rigid, leading to an unsatisfactory formability, but also adversely affects the weldability of the material. To avoid these inconveniences, it is required to set the upper limit for C at 0.0500%.

The lower limit of 10.00% for Cr is required to achieve a desired level of corrosion resistance. Whereas, an excessively high Cr impairs the toughness as well as the secondary workability of the material. For this reason the upper limit for Cr is set at 18.00%.

Si serves to improve the oxidation resistance of the material at an elevated temperature. But the upper limit for Si is set at 0.50%, since an excessively high Si renders the material unduly rigid.

Mn is an element, which improves the hot workability of the material and the toughness of weld zones of the material. With more than 0.50% of Mn, however, such effects tend to be saturated and the product becomes expensive. For these reasons the upper limit for Mn is set at 0.50%.

S is a harmful element, which adversely affects the corrosion resistance and hot workability of the material, and thus, the lower the content of S the more we prefer. The allowable upper limit for S is now set at 0.030%.

Ni has a beneficial effect to improve the toughness of the ferritic materials. But a high content of Ni renders the product expensive contrary to the purpose of the invention. Accordingly, the upper limit of 0.60% for Ni as prescribed with conventional standardized ferritic stainless steels is now adopted as the upper limit for Ni in the alloys according to the invention.

The content of P is critical for the purpose of the invention. With not more than 0.040% of P, a preliminary removal of P from pig iron or a special treatment for removal of P in the converter is required, leading to the increase in the manufacturing costs. In addition, the effects of the enrichment of P, that is the improved pickling performance and formability, are not enjoyed. Accordingly, more than 0.040% of P is required. However, an excessively high P adversely affects the toughness, hot workability and secondary workability of the material. Although such adverse effects of P may be reduced by strictly balancing the other alloying elements in accordance with the invention, we now set the upper limit for P at 0.20%.

Al acts as a deoxidizer in a steel making process to reduce the oxygen content in the steel and to clean the steel, Further, acid soluble Al (Sol. Al) contributes to suppress the adverse effects of P on the toughness and secondary workability of the product. To enjoy such beneficial effect of Sol. Al, at least 0.005% of Sol. Al is required. However, with more than 0.200% of Sol. Al, such an effect tends to be saturated on the one hand, and a technological problem may be posed on the other hand regarding clogging of nozzles in the casting step. For these reasons we set the upper limit for Sol. Al at 0.200%.

B, even with a very small amount, effectively acts to improve the secondary workability of the material. To achieve a secondary workability of a level represented by a transition temperature of about 0° C., a trace of B may be sufficient, provided that the amounts of other alloying elements are appropriately controlled. However, at least 0.0020% of B is required to achieve an excellent secondary workability of a level as represented by a transition temperature of −10° C. or below. The upper limit for B is set at 0.0050%, since as the B content approaches 0.0050% the beneficial effect of B is saturated and B tends to impair the formability of the product.

N is not very critical for the purpose of the invention. It inevitably comes into the product in the course of the steel making process and may be contained in the ferritic stainless steel in accordance with the invention in an amount ranging from 0.0050% to 0.05% as it appears in the conventional ferritic stainless steels.

Characteristic features and advantageous results of the invention will be further described by the following working and control examples.

Molten steels having chemical compositions indicated in Table 2 were prepared. From each molten steel a hot rolled strip having a thickness of 3.2 mm was prepared. A piece of the hot rolled strip was descaled by pickling, and thereafter cold rolled to a thickness of 0.7 mm without any intermediate anneal, and then subjected to finish annealing comprising the steps of even heating at a temperature of 820° C. for one minute and allowing to cool in air.

The steel specimens so prepared were tested for the $\overline{\gamma}$ value and the secondary workability. The $\overline{\gamma}$ value was calculated in accordance with $$\overline{\gamma}=(r_o+2r_{45}+r_{90})/4$$

wherein the $r_0$, $r_{45}$ and $r_{90}$ are Lankford values measured along the directions of 0°, 45° and 90° relative to the direction of rolling, respectively. For the estimation of the secondary workability, the cup expansion test, mentioned above was carried out to determine the transition temperature.

Test results are also shown in Table 2.

The following can be revealed.

Steels Nos. 6, 7 and 14–17 according to the invention have fairly high $\overline{\gamma}$ values indicating their excellent ability of being deeply drawn in combination with very low transition temperatures well below −10° C. reflecting their excellent secondary workability.

Control steel No. 9 has a low P content as in conventional ferritic stainless steels. Accordingly, it does not enjoy advantages brought about by enrichment of P. Its $\overline{\gamma}$ value is low, indicating a poor ability of being deeply drawn, although it has a good secondary workability.

Other control steels have P enriched, and therefore, they have high $\overline{\gamma}$ values indicating their excellent formability. But the adverse effect of the enriched P on the secondary workability is not completely eliminated.

TABLE 2

| | Chemical Composition of Steels (% by weight) and Properties | | | | | | | | | | | |
|---|---|---|---|---|---|---|---|---|---|---|---|---|
| Steel No. | C | Si | Mn | P | S | Cr | Ni | sol. Al | N | B | $\overline{\gamma}$ value | $T_{tr.}$(°C.) |
| 1 | 0.0468 | 0.35 | 0.20 | 0.104 | 0.005 | 10.45 | 0.06 | 0.045 | 0.0082 | tr. | 1.50 | 0 |
| 2 | 0.0121 | 0.09 | 0.17 | 0.089 | 0.006 | 11.29 | 0.10 | 0.012 | 0.0120 | tr. | 1.42 | 0 |
| 3 | 0.0220 | 0.27 | 0.23 | 0.181 | 0.001 | 12.43 | 0.07 | 0.058 | 0.0250 | 0.0010 | 1.49 | −5 |
| 4 | 0.0318 | 0.42 | 0.22 | 0.067 | 0.010 | 14.58 | 0.06 | 0.033 | 0.0060 | tr. | 1.37 | 0 |
| 5 | 0.0450 | 0.30 | 0.36 | 0.092 | 0.004 | 16.72 | 0.30 | 0.120 | 0.0087 | tr. | 1.65 | 0 |
| 6 | 0.0375 | 0.18 | 0.12 | 0.053 | 0.007 | 16.85 | 0.07 | 0.010 | 0.0210 | 0.0042 | 1.21 | <−30 |
| 7 | 0.0089 | 0.25 | 0.23 | 0.085 | 0.005 | 17.50 | 0.06 | 0.052 | 0.0069 | 0.0035 | 1.34 | <−30 |
| 8 | 0.0308 | 0.29 | 0.24 | 0.250 | 0.005 | 11.34 | 0.07 | 0.023 | 0.0103 | tr. | 1.32 | +30 |
| 9 | 0.0283 | 0.10 | 0.28 | 0.027 | 0.010 | 11.03 | 0.06 | 0.037 | 0.0081 | tr. | 0.87 | <−30 |
| 10 | 0.0028 | 0.48 | 0.19 | 0.084 | 0.008 | 12.59 | 0.10 | 0.063 | 0.0143 | tr. | 1.45 | +30 |
| 11 | 0.0359 | 0.23 | 0.23 | 0.151 | 0.006 | 16.32 | 0.08 | 0.029 | 0.0121 | tr. | 1.51 | +20 |
| 12 | 0.0085 | 0.28 | 0.20 | 0.078 | 0.005 | 16.69 | 0.06 | 0.003 | 0.0230 | tr. | 1.43 | +25 |
| 13 | 0.0342 | 0.36 | 0.27 | 0.062 | 0.006 | 19.70 | 0.10 | 0.004 | 0.0080 | tr | 1.33 | +5 |
| 14 | 0.0450 | 0.42 | 0.30 | 0.092 | 0.003 | 10.33 | 0.13 | 0.017 | 0.0095 | 0.0022 | 1.53 | −25 |
| 15 | 0.0184 | 0.16 | 0.19 | 0.157 | 0.005 | 11.46 | 0.15 | 0.023 | 0.0331 | 0.0028 | 1.67 | −15 |
| 16 | 0.0245 | 0.09 | 0.25 | 0.091 | 0.005 | 12.28 | 0.09 | 0.039 | 0.0088 | 0.0030 | 1.46 | −30 |
| 17 | 0.0263 | 0.15 | 0.18 | 0.089 | 0.004 | 15.03 | 0.12 | 0.154 | 0.0411 | 0.0045 | 1.49 | <−30 |

$T_{tr.}$: Transition temperature

We claim:

1. P-Added ferritic stainless steel having excellent formability and secondary workability consisting essentially of, in % by weight, C; 0.0050 to 0.0500%,
Cr; 10.00 to 18.00%,
Si; up to 0.50%,
Mn; up to 0.50%,
P; more than 0.040% but not more than 0.200%,
S; up to 0.030%,
Ni; up to 0.60%,
Sol.Al; 0.005 to 0.200%, and
B; 0.0020 to 0.0050%, the balance being Fe and unavoidable impurities, and having a longitudinal cracking transition temperature of not higher than −10° C. as determined by the cup expansion test hereinbefore described.

* * * * *